US005096041A

United States Patent [19]

van Ravenhorst

[11] Patent Number: 5,096,041

[45] Date of Patent: Mar. 17, 1992

[54] METHOD AND APPARATUS FOR RECEIVING AND DELIVERING ARTICLES WITH DIFFERING MOTION CHARACTERISTICS

[75] Inventor: Barend van Ravenhorst, Barneveld, Netherlands

[73] Assignee: Terpa Poultry B.V., Netherlands

[21] Appl. No.: 491,055

[22] Filed: Mar. 9, 1990

[30] Foreign Application Priority Data

Mar. 10, 1989 [NL] Netherlands ..... 8900584

[51] Int. Cl.[5] ..... B65G 47/30

[52] U.S. Cl. ..... 198/343.1; 198/418.6; 198/631

[58] Field of Search ..... 198/631, 812, 418.6, 198/343.1, 460, 794, 358, 432, 570; 209/514

[56] References Cited

U.S. PATENT DOCUMENTS

| | | | |
|---|---|---|---|
| 1,973,196 | 9/1934 | Baker | 198/343.1 X |
| 2,551,080 | 5/1951 | Allen et al. | 198/343.1 |
| 2,671,552 | 3/1954 | Miller | 198/343.1 |
| 3,016,665 | 1/1962 | Barrett | 198/418.2 X |
| 3,220,154 | 11/1965 | van der Schoot | 198/570 X |
| 3,224,579 | 12/1965 | Scollard et al. | 209/514 |
| 3,260,348 | 7/1966 | Niederer et al. | 198/432 X |
| 3,661,242 | 5/1972 | Clancy . | |
| 3,850,566 | 11/1974 | Moore | 198/343.1 X |
| 4,086,998 | 5/1978 | van der Schoot | 198/358 |
| 4,383,613 | 5/1983 | van Kettenbroek | 209/514 |
| 4,396,109 | 8/1983 | Nambu . | |
| 4,569,444 | 2/1986 | McEvoy et al. . | |
| 4,603,772 | 8/1986 | Tomosue | 198/418.6 |
| 4,708,250 | 11/1987 | van der Schoot . | |

FOREIGN PATENT DOCUMENTS

| | | |
|---|---|---|
| 0048525 | 3/1982 | European Pat. Off. . |
| 1303722 | 5/1973 | Fed. Rep. of Germany . |
| 1169743 | 3/1957 | France . |
| 2519614 | 7/1983 | France . |
| 6717724 | 7/1969 | Netherlands . |
| 81-03133 | 1/1982 | Netherlands . |
| 8300287 | 2/1984 | Netherlands . |
| 1598749 | 9/1981 | United Kingdom . |

*Primary Examiner*—D. Glenn Dayoan
*Attorney, Agent, or Firm*—Larson and Taylor

[57] ABSTRACT

A method of, and apparatus for delivering articles to and discharging articles from a conveyor with differing motion characteristics. The conveyor comprises holders adapted to receive, deliver or handle articles from one or a plurality of supply devices adjacent to the conveyor, where each time only the part thereof which adjoins the supply device(s) stands still temporarily. One or more supply devices is or are arranged near one run of the conveyor, and one or more discharging or transferring mechanisms is or are disposed near the other run, the two runs of the conveyor following different motion characteristics.

25 Claims, 4 Drawing Sheets

METHOD AND APPARATUS FOR RECEIVING AND DELIVERING ARTICLES WITH DIFFERING MOTION CHARACTERISTICS

BACKGROUND OF THE INVENTION

This invention relates to an apparatus and method for delivering articles (such as eggs) to and discharging articles from a conveyor. A receiving run of the conveyor and a discharge run of the conveyor have differing motion characteristics. This invention includes a method for temporarily stopping a driven conveyor guided over reversing rollers, said conveyor comprising holders adapted to receive, deliver, or handle such articles from one or a plurality of supply devices superjacent or adjacent to said conveyor, and in which it is each time only the part thereof which adjoins the supply device(s) that stands still temporarily.

Such a method, and apparatus, are disclosed in German Auslegeschrift 1,303,722, and also in French patent 1,169,743. It is an object of the present invention to provide a method of the above kind which offers the possibility of carrying out with, or on the articles, a plurality of operations independently one after the other.

SUMMARY OF THE INVENTION

To this effect, the method is characterized in that one or more supply devices is or are arranged near one run of the conveyor, referred to as a receiving run, and one or more discharging or transferring mechanisms is or are disposed near the other run, referred to as a discharging run, the two runs of the conveyor following different motion characteristics.

The invention also relates to an apparatus for carrying out the method described, using a reciprocating carriage, and is characterized in that the two runs each have their own separate drive unit.

In one embodiment of the invention, the receiving part or run of the conveyor travels intermittently by increments of a number of holder distances equal to the number of supply devices, and the discharging part or run of the conveyor travels intermittently by increments of a number of holder distances equal to the number of discharging or transferring mechanisms.

In a further elaboration of the invention, the receiving part or run of the conveyor travels intermittently by increments of a number of holder distances equal to the number of actively functioning supply devices (that is to say, the supply devices need not all be active, but may for example stand still, be empty, or the like), and the discharging part or run travels intermittently by increments of a number of holder distances equal to the number of actively functioning discharging or transferring mechanisms.

A further possibility is that the receiving part or run of the conveyor travels intermittently by increments of a number of holder distances equal to the number of supplying devices, and the discharging part of the conveyor discharges the articles in a continuous movement.

In a further elaboration of the invention, the conveyor is arranged to function also as an article buffer, i.e., that the receiving part can receive a number of articles without the discharging part discharging the same number of articles at the same time.

Furthermore, the conveyor may comprise multiple article holders for simultaneously receiving or delivering a plurality of articles at a time (see FIG. 4).

The various motion characteristics of the two conveyor runs as well as the buffer function may be brought about by a carriage mounting the reversing rollers, said carriage being movable in a fixed frame (see FIG. 5).

In a further elaboration thereof, the two conveyor runs are driven by two drive means mounted in said carriage and running parallel to the conveyor, and which drive means, from two driving shafts mounted in said fixed frame, the first of which drives the article receiving part and the other the article delivering part, drives both according to the desired driving characteristics.

The desired driving characteristics can be realized in a simple manner by means of commercially available indexing units, camming mechanisms, or electromagnetically or mechanically controlled clutches or stepping motors.

The above-described method and apparatus also offer the possibility of uniformly filling two or more containers provided with article receiving cells from two or more independently and non-uniformly filled article supplying devices through one buffer conveyor provided with article holders and with two or more article delivering mechanisms, which method is characterized for the purpose in that the containers to be filled are supplied on the same packaging conveyor.

In that embodiment, each of the article delivering mechanisms may place one selected row of articles in each container.

Some embodiments of an apparatus for temporarily stopping a driven conveyor guided over reversing rollers, with holders for receiving and delivering articles, will now be described, by way of example, with reference to the accompanying drawings. In said drawings,

DETAILED DESCRIPTION OF THE PREFERRED EMBODIMENTS

Figure 1:
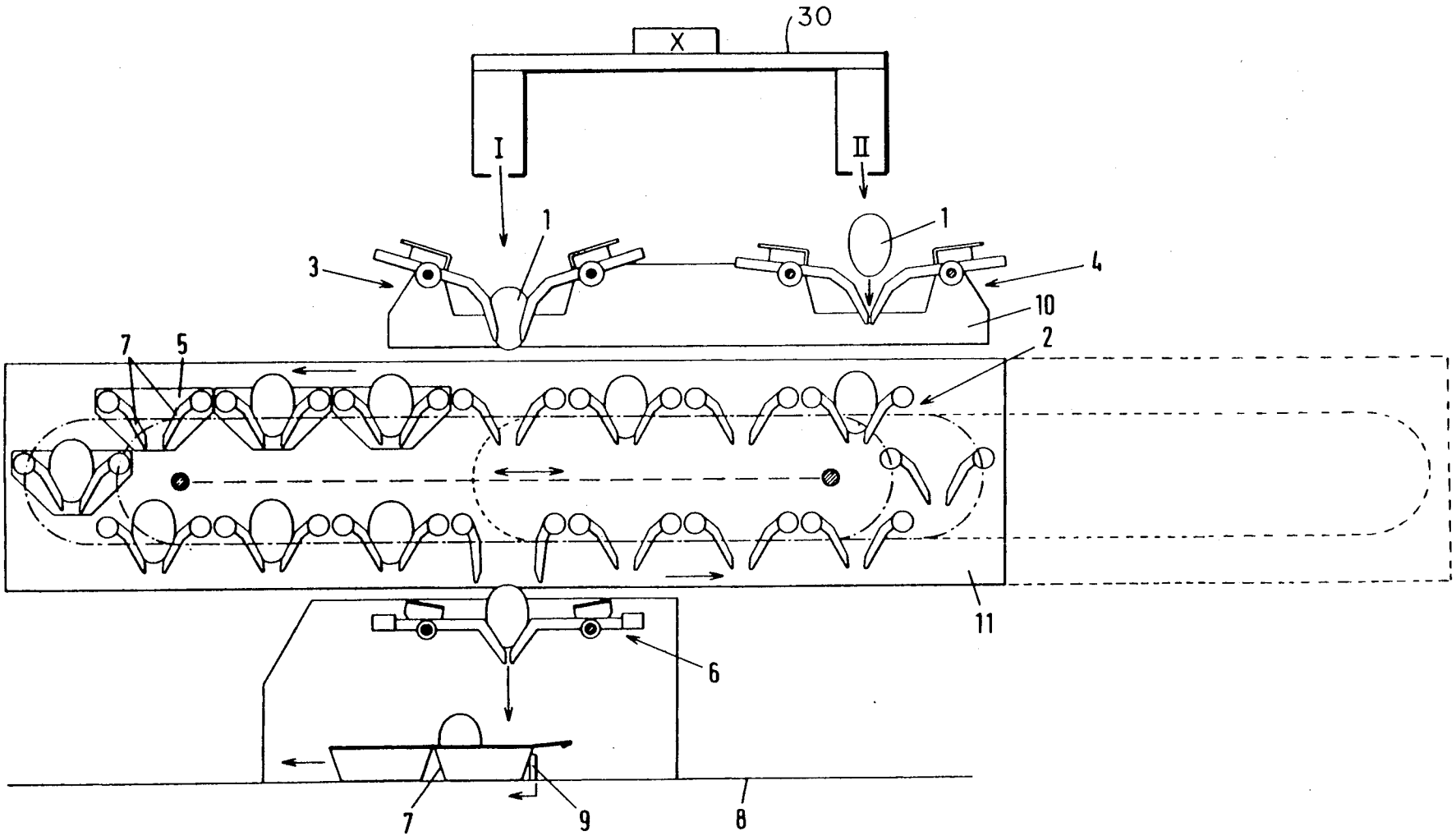
FIG. 1 shows a diagrammatic side-elevational view of a conveyor for receiving eggs from, in this instance, two supplying devices, and delivering the same to a packaging unit.

As shown in FIG. 1, an apparatus for receiving and delivering eggs 1 comprises a conveyor 2. Provided above conveyor 2 are a plurality, in the present case two, supply devices 3, 4 moving transversely to the direction of travel of conveyor 2. Supply devices 3 and 4 will not be described further herein, as they are disclosed in British patent 1,598,749 (which corresponds to Netherlands patent 175,964) and in U.S. Pat. No. 4,383,613 (which corresponds to Netherlands patent 175,389). Supply devices 3 and 4 are fed by means of carrier chains I and II, moving over them, and shown schematically in both FIG. 1 and FIG. 2. Chains I and II are mounted on a common carrier 30, shown in FIGS. 1, 2 and 3.

Conveyor 2 essentially consists of holders 5 secured to an endless chain, and each equipped with a large number of rotatable fingers 7 together forming a carrying cavity. As shown in the drawings, the cavities are filled at the top of conveyor 2 by means of a supply device 3 or 4, and are opened at the bottom for delivering the eggs through a discharging device 6 to a container 7 disposed on conveyor belt 8, which last is equipped with pushers 9 (only one of which is shown in FIG. 1). The discharging device designated by 6 may be similar to that designated by 3 and 4, so that device 6 will not be described in further detail herein either.

For the sake of completeness, it is noted that the chain with holders 5, as indicated hereinbefore, is described in detail in applicants' U.S. Pat. No. 3,220,154, and will not, therefore, be described in any detail herein.

As shown in FIG. 1, supply devices I and II are mounted in a frame 10.

Conveyor 2, which is equipped with a pair of reversing rollers, not shown, is mounted in a reciprocating carriage 11, the traveling distance of which is shown in dash lines.

Figure 2:
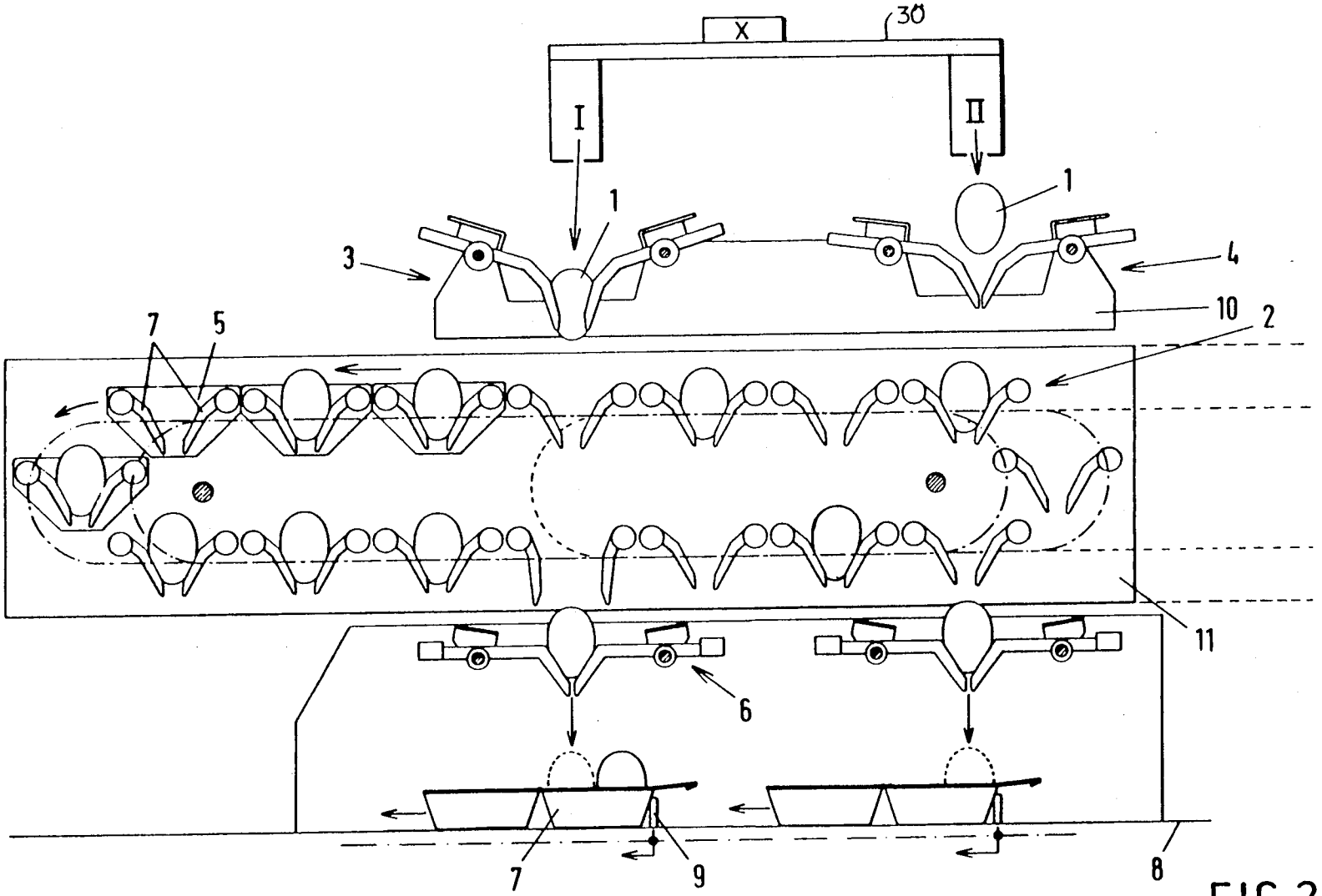
FIG. 2 shows an elevational view of an apparatus similar to FIG. 1, but formed with two separate delivering devices.

The embodiment shown in FIG. 2 shows a construction comprising two discharging devices 6. As shown, in the rear station, as viewed in the downstream direction, an egg is introduced first, and subsequently, in the next station as viewed in the downstream direction an egg is introduced into the first receptacle or cavity of tray 7, so that in each step a tray is completely filled.

Figure 3:
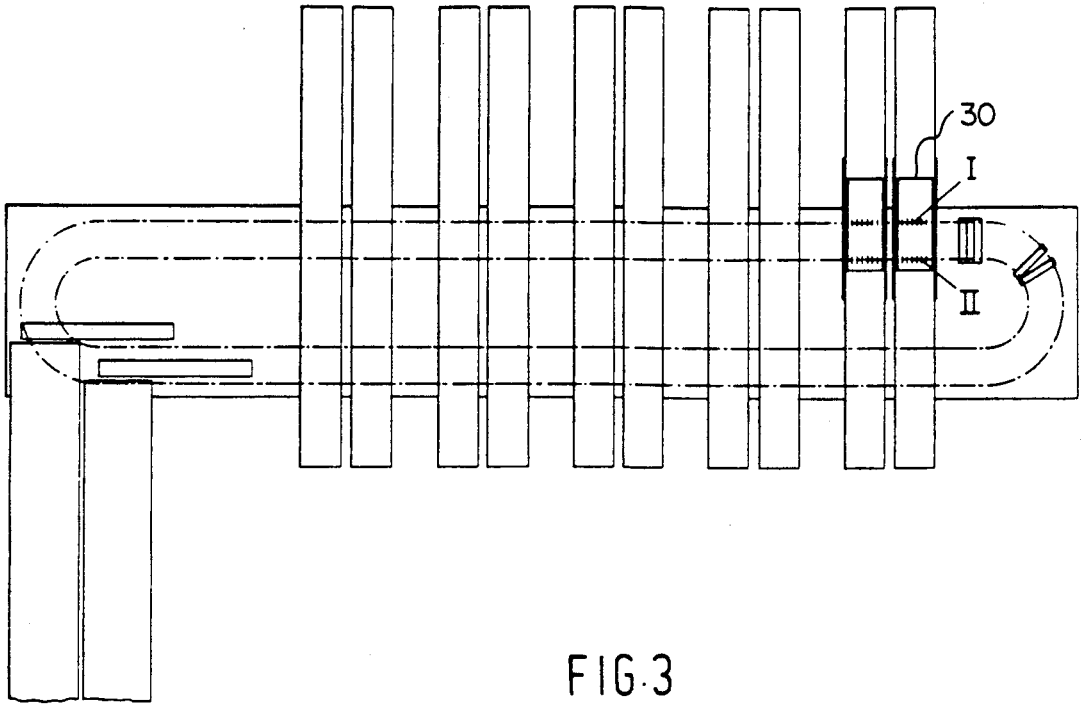
FIG. 3 shows a diagrammatic top plan view of a sorter for articles, such as eggs, incorporating the apparatus of FIG. 1.

The apparatus shown in FIG. 3 is described in detail in the above Netherlands patent 175,389, or the corresponding U.S. Pat. No. 4,383,613, so that it will not be described in detail herein.

Figure 5:
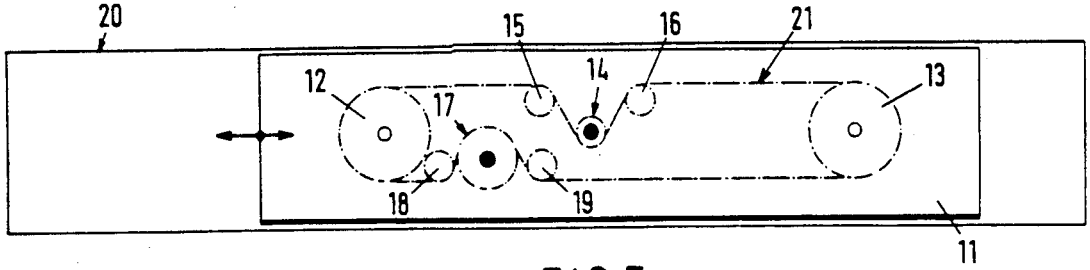
FIG. 5 shows a diagrammatic side-elevational view of the drive of the conveyor illustrated in the preceding Figures.

As shown in FIG. 5, conveyor 2 is mounted in a carriage 11 mounted for reciprocating movement. Conveyor 2 is driven by a drive means 21, consisting for example of a chain or gear belt. This drive means moves over a pair of reversing rollers 12, 13. The upper run thereof is driven by a drive unit 14, with tensioning rollers 15 and 16 being disposed on opposite sides thereof.

Similarly, at the lower run, a drive unit 17 is provided for the delivery part with a pair of tensioning rollers 18 and 19 on opposite sides thereof.

Figure 4:
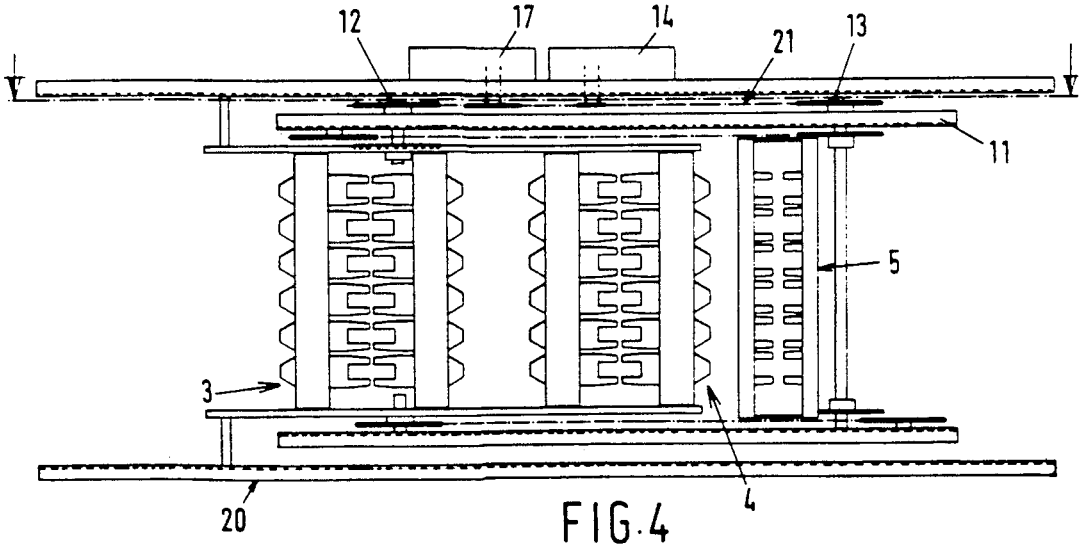
FIG. 4 shows a top plan view of the apparatus illustrated in FIG. 2.

FIG. 4, which shows a top plan view of a part of the apparatus of FIG. 2, shows a pair of supply devices 3, 4, fixedly secured to frame 20. On the right-hand side of FIG. 4, a top plan view of a holder 5 is shown. As the apparatus is fully known per se, it will not be described in any detail herein.

Figure 6:
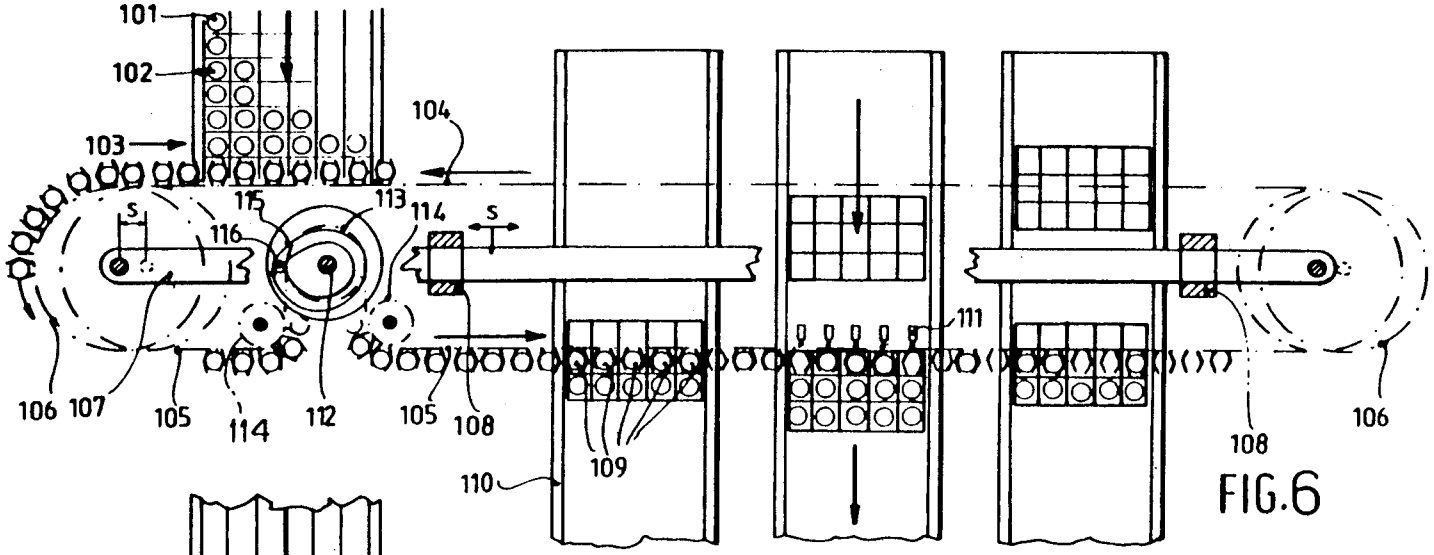
FIG. 6 shows a diagrammatic top plan view of a different embodiment of a continuously moving conveyor, a part of which can be temporarily stopped at intervals.
Figure 7:
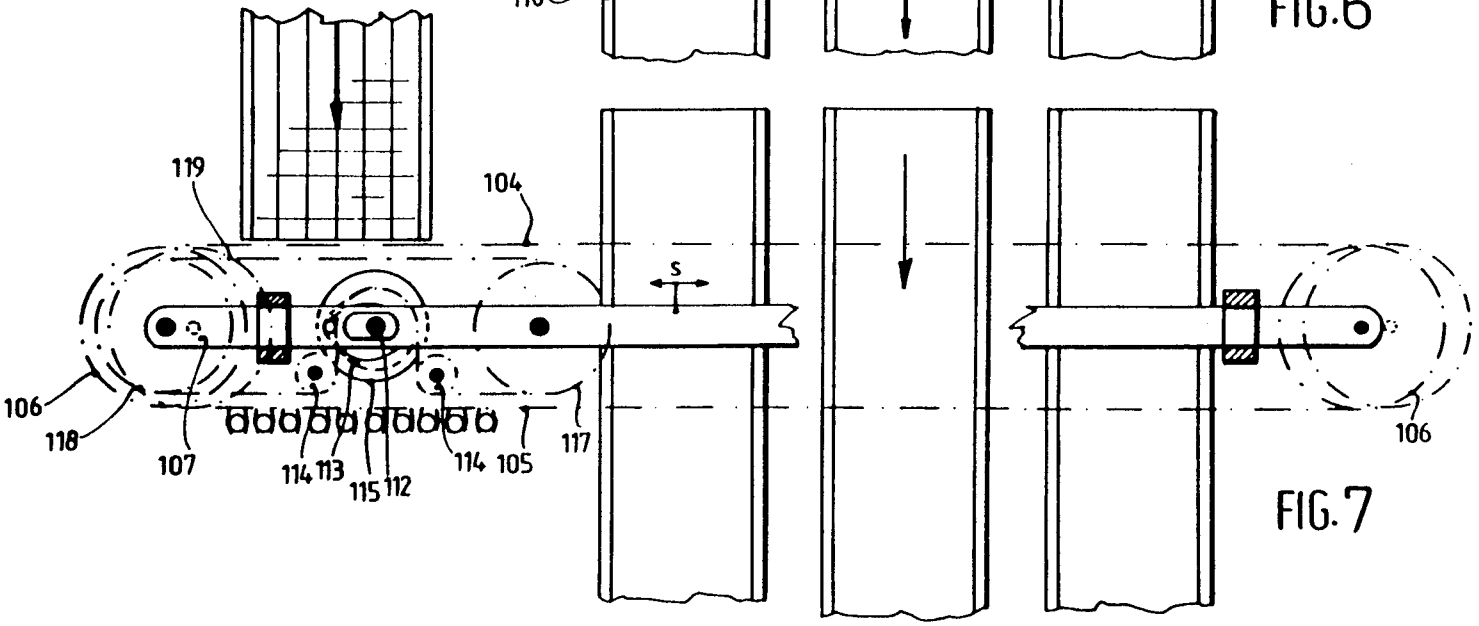
FIG. 7 shows a corresponding view of yet another embodiment of the conveyor.

In the embodiment illustrated in FIGS. 6 and 7, eggs 101 supplied on a supply belt 102 are transferred in a row 103 to a conveyor part or run 104, which stands still at the moment of transfer. For details thereof, reference is made to applicants' U.S. Pat. No. 4,086,998.

Disposed in opposition to conveyor run 104 are two conveyor parts 105, which however are driven continuously at a constant rate, so that the articles can be discharged as desired, and in sequence, at any packaging position 109 of the associated sorter tracks 110 by means of a discharging mechanism 11, which is not described herein, as it is disclosed in, for example, the above U.S. Pat. No. 4,086,998.

The realization of the standstills of the conveyor part 104, which forms part of a continuously driven endless conveyor 104, 105, is accomplished as follows. Conveyor part 105 is provided with a loop portion determined by drive wheel 113 and circulating wheels 114. Wheel 113 is mounted on a main drive shaft 112 mounted in a frame not shown, and is driven by a motor not shown. Provided on shaft 112 is further a cam 115 incorporating a follower roller 116 mounted on a carriage 107 journalled in guide blocks 108 secured to the frame not shown. Carriage 107 carries reversing rollers 106 of conveyor 104, 105. When shaft 112 is rotated, cam 115 is rotated, with the result that carriage 107 is reciprocated in accordance with the double arrow s, and so is conveyor 104, 105. The two end positions of rollers 106 are shown in dash-dot lines.

The shape of the cam has been selected so that, during the desired period of standstill of conveyor part 104, the movement of carriage 107 is directed oppositely to that of conveyor part 104, but in velocity is a certain proportion thereof, conveyor part 104 is, as it were, relatively moved back, so that in an absolute sense it comes to a standstill, or at least will get a different motion characteristic.

In the embodiment illustrated in FIG. 6, conveyor 104, 105 performs a loop-shaped movement, which, however, gives quite some problems in constructional respect, if vulnerable articles, such as eggs, are transported with the holders of the conveyor.

A solution to this problem is given in FIG. 7, in which like parts are designated by like reference numerals.

In the embodiment Of FIG. 7, conveyor part 104 travels straight on, similarly to conveyor part 104 of FIG. 6. In order to achieve the desired period of standstill, however, carriage 107 in this embodiment is equipped with reversing rollers 117, 118, about which a drive chain 119 is lapped. As the reversing rollers move along with the carriage, these are shown in both final positions. Chain 119 is driven by gear 113 with circulating wheels 114, similarly to the construction FIG. 6. Drive gear 113 is in this case mounted on a drive shaft 112. Drive means 112–115 are fixedly mounted on a frame not shown. The carriage is now moved to and fro in the same manner as described hereinbefore with reference to FIG. 6, so that conveyor part 104 can be temporarily stopped during intervals.

In the embodiments shown in FIGS. 6 and 7, the cam 115 on shaft 112 controls the follower roller are both mounted on the carriage, but this is not essential. It is also possible to have embodiments using a lever mounted for rotation on the frame outside the circumference of the conveyor, and the other end of which is rotatably connected to the carriage, the follower roller being mounted between these two points for cooperation with a rotating cam. In the last case, the cam can be mounted on the drive shaft in the same way as described before. Similarly, countless variants are possible without departing from the scope of the present invention.

What I claim is:

1. A method of handling articles supplied to and discharged from a conveyor, comprising the steps of:

operating an endless conveyor such that it has an article receiving run and an article discharge run;

receiving articles on the receiving run of the conveyor from a supply device or devices while causing the receiving run to move with first motion characteristics appropriate for receiving articles thereon from the supply device or devices;

discharging articles from the discharge run of the conveyor run onto a discharge mechanism or mechanisms while causing the discharge run to move with second motion characteristics appropriate for the discharge of articles therefrom onto the discharge mechanism or mechanisms; and the first motion characteristics associated with the receiving run and the second motion characteristics associated with the discharge run being the same or different from each other, as necessary in order that the conveyor matches the motion of said receiving and discharge runs to the respective operations of the supply device or devices and discharge mechanism or mechanisms, respectively.

2. A method according to claim 1, wherein the motion characteristics of the receiving run include temporarily stopping it to receive articles from the supply device or devices while allowing the discharge run to continue moving.

3. A method according to claim 1, wherein the endless conveyor is mounted for movement about opposed reversing rollers, and including the step of compensating for differing motion characteristics of the receiving run and the discharge run by shifting the axes of the reversing rollers in a direction perpendicular to such axes.

4. A method according to claim 1, wherein the supply device has a plurality of side by side rows, both of which discharge articles onto the endless conveyor, and including the step of discharging articles from the discharge mechanism or mechanisms onto a packaging conveyor, and wherein articles of a given characteristic received from all supply devices onto the endless conveyor are discharged onto the same packaging conveyor.

5. A method according to claim 4, including discharging articles from the endless conveyor into a plurality of discharge mechanisms, all of which discharge articles onto the said same conveyor.

6. An apparatus for handling articles, comprising:

an endless conveyor having a receiving run and a discharge run;

a supply device or devices for supplying articles to the receiving run of the conveyor and a discharge mechanism or mechanisms for receiving articles discharged from the discharge run;

drive means for driving the endless conveyor such that the two said runs have the same or different motion characteristics, the motion characteristics of the receiving run corresponding to operation of the supply device or devices and the motion characteristics of the discharge run corresponding to operation of the discharge mechanism or mechanisms, such that the motion characteristics of the two runs are capable of being the same or differing from each other, as required in order that the motion characteristics of the receiving run correspond to the requirements for receiving articles thereon and the motion characteristics of the discharge run correspond to the requirements of discharging articles therefrom.

7. An apparatus according to claim 6, wherein the drive means includes means for temporarily stopping the receiving run to receive articles from the supply device or devices while allowing the discharge run to continue moving.

8. An apparatus according to claim 6, wherein the endless conveyor is mounted for movement about opposed reversing rollers, and including means for compensating for differing motions of the receiving run and the discharge run by shifting the axes of the reversing rollers in a direction perpendicular to their respective axes.

9. An apparatus according to claim 6, including a plurality of side by side rows of supply devices, a packaging conveyor positioned to receive articles from the discharge mechanism or mechanisms, wherein articles of a given characteristic received from all supply devices onto the endless conveyor are received on the same packaging conveyor.

10. An apparatus according to claim 9, including a plurality of discharge mechanisms, all of which discharge articles onto the said same packaging conveyor.

11. A method of handling articles supplied to and discharged from a conveyor, comprising the steps of:

operating an endless conveyor such that it has an article receiving run and an article discharge run;

driving each of the said receiving and discharge runs with separate, independent drive means, such that the motion characteristics of the two runs are capable of differing from each other, the motion characteristics of the receiving run corresponding to the requirements of receiving articles thereon and the motion characteristics of the discharge run corresponding to the requirements of discharging articles therefrom; and including effecting movement of the conveyor mounting, as required, to compensate for differing motion characteristics of the receiving run relative to the discharge run.

12. A method according to claim 11, wherein the motion characteristics of the article receiving run includes temporarily stopping that run to receive articles from at least one supply device located adjacent the article receiving run.

13. A method according to claim 12, wherein the discharge run discharges articles to a discharge mechanism disposed near the discharge run.

14. A method according to claim 13, wherein operation of the endless conveyor includes moving it along a path about opposed reversing rollers so as to have a first portion and a second portion, the first portion including the article receiving run and the second portion including the article discharge run.

15. A method according to claim 11, including operating the conveyor as a buffer so as to temporarily store an excess of articles thereon by causing the motion characteristics of the article receiving run to momentarily receive more articles than are being discharged by the article discharge run.

16. An apparatus for handling articles, comprising:

an endless conveyor having an article receiving run and an article discharge run;

first and second drive means being operable independently of each other;

the first drive means drivingly engaged to drive the receiving run of the conveyor with motion characteristics corresponding to the requirements of receiving articles thereon, the second drive means drivingly engaged to drive the discharge run with motion characteristics corresponding to the requirements of discharging articles therefrom; and compensating means operatively associated with the endless conveyor to compensate for any momentary inconsistencies in the motion characteristics of the receiving run relative to the discharge run.

17. An apparatus according to claim 16, the endless conveyor being mounted for movement about opposed reversing rollers and having a first portion which includes the receiving run and a second portion which includes the discharge run.

18. An apparatus according to claim 17, the conveyor including discrete article holders adapted to receive, hold and discharge articles, one or more supply devices adjacent the receiving run for delivering articles into the article holders along the receiving run, and one or more article discharge mechanisms disposed adjacent the article discharge run for receiving articles discharged from article holders located along the discharge run.

19. An apparatus according to claim 18, the first drive means comprising means for causing the receiving run to travel intermittently by increments an amount dependent upon the number of supply devices and the second drive means comprising means for driving the discharge run such that it travels intermittently by increments dependent upon the number of discharge mechanisms.

20. An apparatus according to claim 18, wherein the first drive means comprises means for driving the receiving run intermittently by increments dependent upon the number of supply devices while the second drive means drives the discharge run continuously.

21. An apparatus according to claim 16, said compensating means comprising means for momentarily shifting the axes of the reversing rollers.

22. An apparatus according to claim 21, wherein the differing motion characteristics of the receiving and discharge runs of the conveyor comprise a buffer which momentarily receives more articles than are discharged from the conveyor.

23. An apparatus according to claim 22, wherein the compensating means comprises the structure wherein the reversing rollers are mounted on a carriage movable parallel to the direction of movement of the receiving run and the discharge run, a fixed frame, said drive means being mounted to a fix frame, whereby upon differing motion characteristics of the first and second drive means, the reversing rollers and their respective carriage are moveable in said direction of movement of the carriage.

24. An apparatus according to claim 16, wherein the conveyor is operable to function as a buffer wherein the receiving run can receive a number of articles greater than those discharged by the discharge run over a given period of time.

25. An apparatus according to claim 16, wherein the conveyor comprises multiple article holders for simultaneously receiving and discharging a plurality of articles at the same time.

* * * * *